US009113754B1

(12) United States Patent
Taylor

(10) Patent No.: US 9,113,754 B1
(45) Date of Patent: Aug. 25, 2015

(54) BATHTUB CUSHION ASSEMBLY WITH GEL INSERTS

(71) Applicant: Alana Taylor, Montgomery, AL (US)

(72) Inventor: Alana Taylor, Montgomery, AL (US)

( * ) Notice: Subject to any disclaimer, the term of this patent is extended or adjusted under 35 U.S.C. 154(b) by 236 days.

(21) Appl. No.: 13/828,194

(22) Filed: Mar. 14, 2013

(51) Int. Cl.
*A47K 3/024* (2006.01)
*A47K 3/12* (2006.01)

(52) U.S. Cl.
CPC ..... *A47K 3/125* (2013.01); *A47K 3/024* (2013.01)

(58) Field of Classification Search
CPC ..... A47K 3/125
USPC ..... 4/538–595
See application file for complete search history.

(56) References Cited

U.S. PATENT DOCUMENTS

| | | | | |
|---|---|---|---|---|
| 2,461,880 | A * | 2/1949 | Curran | 4/575.1 |
| 4,055,188 | A * | 10/1977 | Pelton | 607/112 |
| 4,511,621 | A * | 4/1985 | Thomas et al. | 428/78 |
| 4,858,259 | A * | 8/1989 | Simmons et al. | 5/644 |
| 5,140,713 | A * | 8/1992 | Pesterfield | 4/575.1 |
| 5,916,088 | A * | 6/1999 | Gueli | 5/639 |
| 6,993,797 | B1 * | 2/2006 | Yang | 4/575.1 |
| D594,264 | S * | 6/2009 | Crocker | D6/601 |
| 7,744,153 | B2 * | 6/2010 | Gentry et al. | 297/180.1 |
| D658,747 | S * | 5/2012 | Zhang | D23/304 |
| 8,474,079 | B1 * | 7/2013 | Gangitano | 5/731 |
| 8,567,347 | B2 * | 10/2013 | Leahy et al. | 119/28.5 |
| 2001/0034907 | A1 * | 11/2001 | Bullock | 4/580 |
| 2005/0138724 | A1 * | 6/2005 | Owen | 4/574.1 |
| 2006/0185071 | A1 * | 8/2006 | White | 4/581 |
| 2006/0272084 | A1 * | 12/2006 | Bauman et al. | 4/575.1 |
| 2007/0022630 | A1 * | 2/2007 | Lundy et al. | 36/28 |
| 2007/0050905 | A1 * | 3/2007 | Fowkes | 4/579 |
| 2007/0214561 | A1 * | 9/2007 | Brooks | 4/575.1 |
| 2007/0256324 | A1 * | 11/2007 | Benfatti | 36/2.6 |
| 2008/0028637 | A1 * | 2/2008 | Benfatti | 36/43 |
| 2008/0148472 | A1 * | 6/2008 | Cline et al. | 4/575.1 |
| 2010/0281712 | A1 * | 11/2010 | Campbell et al. | 36/28 |
| 2011/0041779 | A1 * | 2/2011 | Hurwitz | 119/850 |
| 2013/0298423 | A1 * | 11/2013 | Daem | 36/44 |
| 2013/0318817 | A1 * | 12/2013 | Vattes | 36/28 |
| 2013/0326905 | A1 * | 12/2013 | Vattes et al. | 36/43 |
| 2014/0130247 | A1 * | 5/2014 | Marshall | 4/573.1 |
| 2014/0338221 | A1 * | 11/2014 | Pride | 36/44 |

* cited by examiner

*Primary Examiner* — Lori Baker

(57) ABSTRACT

A bathtub cushion assembly with gel inserts selectively warms and cools a user's body and provides support to the user's body during a bath. The assembly includes a cushion having a head portion, a leg portion, and a middle portion extending between the head portion and the leg portion. The cushion has a top side positioned opposite a bottom side wherein the top side and the bottom side define an interior space configured to receive water and ice. A cavity extends downwardly into the top side of the cushion and through the interior space. A plurality of gel inserts is positioned in the cavity wherein the gel inserts are configured to provide comfort to a back of the user and maintain a temperature of the water and ice stored in the interior space.

14 Claims, 3 Drawing Sheets

BATHTUB CUSHION ASSEMBLY WITH GEL INSERTS

BACKGROUND OF THE DISCLOSURE

Field of the Disclosure

The disclosure relates to cushion assemblies and more particularly pertains to a new cushion assembly for selectively warming and cooling a user's body and providing support to the user's body during a bath.

SUMMARY OF THE DISCLOSURE

An embodiment of the disclosure meets the needs presented above by generally comprising a cushion having a head portion, a leg portion, and a middle portion extending between the head portion and the leg portion. The cushion has a top side positioned opposite a bottom side wherein the top side and the bottom side define an interior space configured to receive water and ice. A cavity extends downwardly into the top side of the cushion and through the interior space. A plurality of gel inserts is positioned in the cavity. The gel inserts are configured to provide comfort to a back of the user and maintain a temperature of the water and ice stored in the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
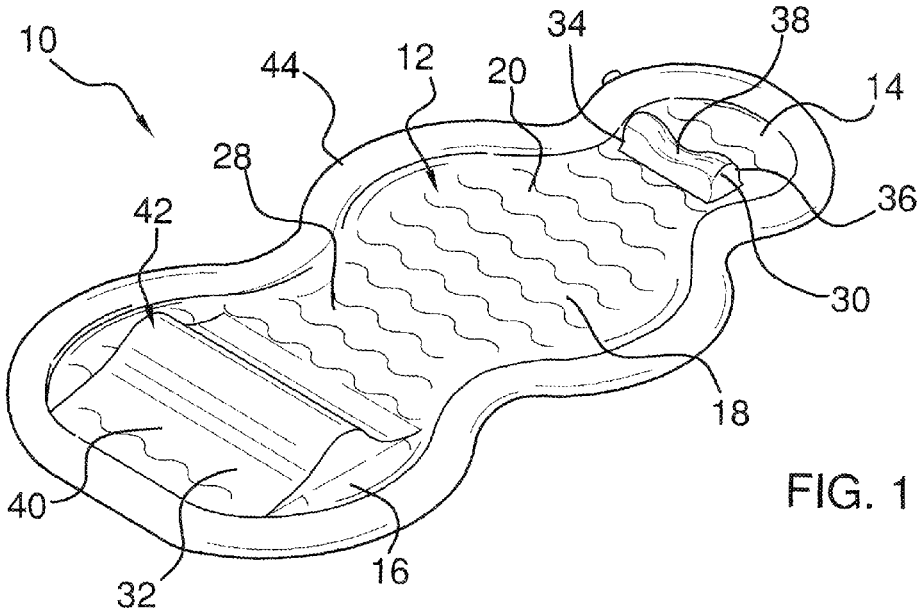
FIG. 1 is a top front side perspective view of a bathtub cushion assembly with gel inserts according to an embodiment of the disclosure.
Figure 2:
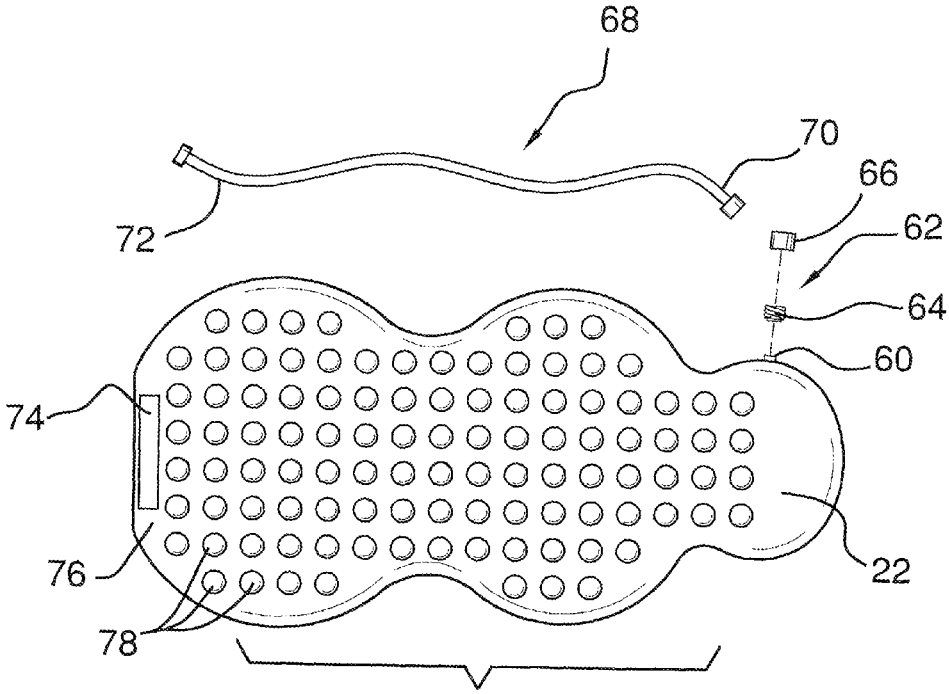
FIG. 2 is a partially-exploded bottom view of an embodiment of the disclosure.
Figure 3:
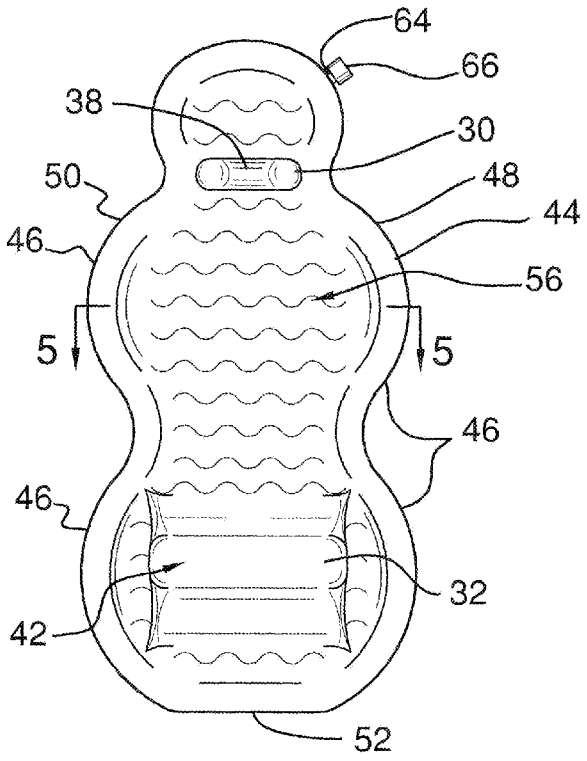
FIG. 3 is a top view of an embodiment of the disclosure.
Figure 4:
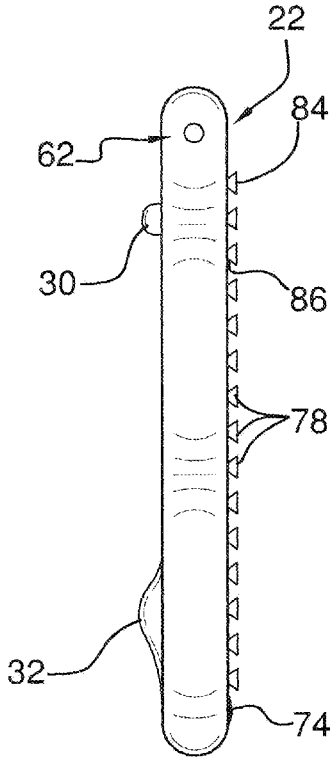
FIG. 4 is a side view of an embodiment of the disclosure.
Figure 5:
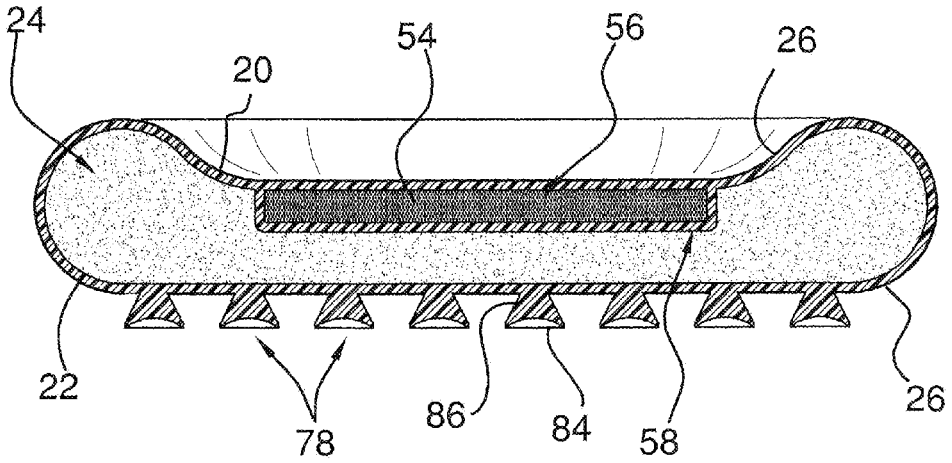
FIG. 5 is a cross-sectional view of an embodiment of the disclosure taken along line 5-5 of FIG. 3.
Figure 6:
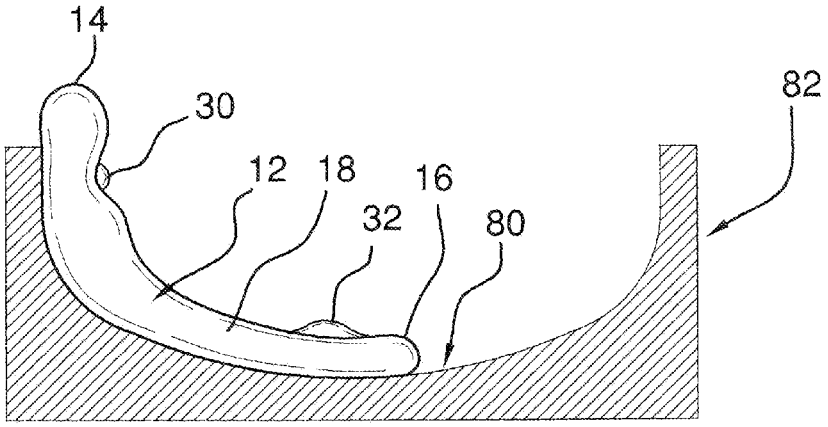
FIG. 6 is a side view of an embodiment of the disclosure in use.

With reference now to the drawings, and in particular to FIGS. 1 through 6 thereof, a new cushion assembly embodying the principles and concepts of an embodiment of the disclosure and generally designated by the reference numeral 10 will be described.

As best illustrated in FIGS. 1 through 6, the bathtub cushion assembly with gel inserts 10 generally comprises a cushion 12 having a head portion 14, a leg portion 16, and a middle portion 18 extending between the head portion 14 and the leg portion 16. In this manner, the cushion 12 contours to a user's body and supports the user's head, neck, back, tail bone, and quadriceps. The cushion 12 has a top side 20 positioned opposite a bottom side 22 wherein the top side 20 and the bottom side 22 define an interior space 24 configured to receive warm water and ice. Each of the top side 20 and the bottom side 22 has a perimeter edge 26. A flat portion 28 of the top side 20 extends from the head portion 14 to the leg portion 16. The flat portion 28 is defined by and inwardly bounded by the perimeter edge 26 of the top side 20. A neck support 30 and a knee support 32 are coupled to the cushion 12. The neck support 30 extends upwardly from the flat portion 28 of the head portion 14 and is coupled to a bottom end 34 of the head portion 14. A top side 36 of the neck support 30 has an arcuate depression 38 configured for receiving a neck of the user. The knee support 32 extends upwardly from the flat portion 28 of the leg portion 16. A top side 40 of the knee support 32 has an outwardly curved projection 42 configured for receiving a back side of a knee of the user. The cushion 12 is preferably made from a material that will not scratch a bathtub 82, including rubber, plastic, or silicon. The cushion 12 has a size such that the cushion 12 will fit in an average-sized bathtub 82, which typically has a width between approximately 50 and 100 centimeters and a length between approximately 125 and 175 centimeters.

A laterally projecting lip 44 extends from each of an associated one of the perimeter edges 26. Each lip 44 is aligned with and extends a full length around the associated one of the perimeter edges 26. The lip 44 of the top side 20 protrudes upwardly from the flat portion 28 wherein the lip 44 of the head portion 14 is configured to provide support to a head of a user and the lip 44 of the middle portion 18 is configured to provide support to arms of the user. The lips 44 are convexly curved around the head portion 14, the middle portion 18, and the leg portion 16. The lips 44 of the middle portion 18 and the leg portion 16 each has a pair of curves 46 positioned on an associated one of a first side 48 and a second side 50 of the cushion 12. The lip 44 of the leg portion 16 has a straight portion 52 extending between and coupling the curves 46 of the leg portion 16.

A cavity 54 extends downwardly into the top side 20 of the cushion 12 and extends through the interior space 24. The cavity 54 is positioned below the flat portion 28. A plurality of gel inserts 56 is positioned in the cavity 54. The gel inserts 56 extend the full length and width of the cavity 54 wherein the gel inserts 56 are configured to provide comfort to a back of the user and maintain a temperature of the water and ice stored in the interior space 24 of the cushion 12. The cavity 54 has a periphery 58 configured to maintain the gel inserts 56 in the cavity 54.

A tab 60 is coupled to the cushion 12 and extends outwardly from the first side 48 of the cushion 12. The tab 60 is coupled to the head portion 14. A cap assembly 62 is couplable to the cushion 12. The cap assembly 62 may be screwed onto the cushion 12. The cap assembly 62 comprises a hose cap 64 and an end cap 66. Both the hose cap 64 and the end cap 66 are removed for inserting ice into the interior space 24. After ice is inserted into the interior space 24, the hose cap 64 is coupled to the tab 60. The hose cap 64 is threaded. The cap assembly 62 is selectively couplable to the head portion 14 wherein the hose cap 64 is couplable to the tab 60 and the end cap 66 is positionable over the hose cap 64. The end cap 66 is configured to prevent water from exiting the interior space 24 of the cushion 12 when the end cap 66 is coupled to the hose cap 64 and the cap assembly 62 is coupled to the cushion 12. A hose 68 is couplable to the cushion 12. The hose 68 has a first end 70 and a second end 72 wherein the first end 70 of the hose 68 is coupled to the cushion 12 and the second end 72 of the hose 68 is configured for coupling to a water source, such as a sink or a faucet in the bathtub 82. In this manner, the interior space 24 may be filled with water. The hose cap 64 prevents water from exiting the interior space 24 while filling the cushion 12 with water. The hose 68 is in fluid communication with the cushion 12 when the first end 70 of the hose 68 is coupled to the hose cap 64 and the hose cap 64 is coupled to the tab 60.

A plug 74 is positioned in the cushion 12. The plug 74 is selectively removable from the bottom side 22 of the cushion 12 wherein the plug 74 is configured to release water from the interior space 24 when the plug 74 is removed from the cushion 12. The plug 74 is flat and substantially rectangular. The plug 74 is positioned on the leg portion 16 proximate a bottom end 76 of the cushion 12. The plug 74 is preferably made from rubber or similar material and snaps into the cushion 12. A plurality of suction cups 78 is coupled to the cushion 12. The suction cups 78 extend downwardly from the bottom side 22 of the cushion 12 wherein the suction cups 78 are configured to secure the cushion 12 to a surface 80 of the bathtub 82. Each of the suction cups 78 comprises a working face 84 coupled to an extension 86. The working face 84 is curved wherein the working face 84 is configured to attach to the bathtub 82 when the working face 84 is pressed against the surface 80 of the bathtub 82.

In use, as stated above and shown in the Figures, the interior space 24 is filled with warm water or ice as desired. The suction cups 78 are pressed against a surface 80 of the bathtub 82 such that the cushion 12 is secured to the bathtub 82. A user then lays down on the cushion 12 wherein the user's neck is positioned to rest on the neck support 30 and the user's knee is positioned to rest on the knee support 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathtub cushion assembly with gel inserts comprising:

a cushion having a head portion, a leg portion, and a middle portion extending between said head portion and said leg portion, said cushion having a top side positioned opposite a bottom side wherein said top side and said bottom side define an interior space configured to receive water and ice;

a cavity extending downwardly into said top side of said cushion, said cavity extending through said interior space of said cushion; and a plurality of gel inserts positioned in said cavity wherein said gel inserts are configured to provide comfort to a back of the user and maintain a temperature of the water and ice stored in said interior space of said cushion; and a cap assembly couplable to said cushion.

2. The assembly of claim 1, further comprising:

each of said top side and said bottom side having a perimeter edge; and a flat portion of said top side extending from said head portion to said leg portion, said flat portion being defined by and inwardly bounded by said perimeter edge of said top side.

3. A bathtub cushion assembly with gel inserts comprising:

a cushion having a head portion, a leg portion, and a middle portion extending between said head portion and said leg portion, said cushion having a top side positioned opposite a bottom side wherein said top side and said bottom side define an interior space configured to receive water and ice;

a cavity extending downwardly into said top side of said cushion, said cavity extending through said interior space of said cushion;

a plurality of gel inserts positioned in said cavity wherein said gel inserts are configured to provide comfort to a back of the user and maintain a temperature of the water and ice stored in said interior space of said cushion;

each of said top side and said bottom side having a perimeter edge;

a flat portion of said top side extending from said head portion to said leg portion, said flat portion being defined by and inwardly bounded by said perimeter edge of said top side; and a laterally projecting lip extending from each of an associated one of said perimeter edges, each said lip being aligned with and extending a full length around said associated one of said perimeter edges.

4. The assembly of claim 3, further comprising:

wherein said lips are convexly curved around said head portion, said middle portion, and said leg portion;

wherein said lips of said middle portion and said leg portion each have a pair of curves positioned on an associated one of a first side and a second side of said cushion; and wherein said lip of said leg portion has a straight portion extending between and coupling said curves of said leg portion.

5. The assembly of claim 3, further comprising:

a neck support coupled to said cushion, said neck support extending upwardly from said flat portion of said head portion, a top side of said neck support having an arcuate depression configured for receiving a neck of the user;

a knee support coupled to said cushion, said knee support extending upwardly from said flat portion of said leg portion, a top side of said knee support having an outwardly curved projection configured for receiving a back side of a knee of the user;

wherein said lip of said top side protrudes upwardly from said flat portion wherein said lip of said head portion is configured to provide support to a head of a user; and wherein said lip of said middle portion is configured to provide support to arms of the user.

6. The assembly of claim 1, further comprising:

a cavity extending downwardly into said top side of said cushion, said cavity extending through said interior space of said cushion; and wherein said cavity has a periphery configured to maintain said gel inserts in said cavity.

7. The assembly of claim 1, further comprising:

a tab coupled to said cushion, said tab extending outwardly from said first side of said cushion, said tab being coupled to said head portion;

wherein said cap assembly comprises a hose cap and an end cap, said end cap being configured to prevent water from exiting said interior space of said cushion when said end cap is coupled to said hose cap and said cap assembly is coupled to said cushion; and wherein said cap assembly is selectively couplable to said head portion such that said hose cap is couplable to said tab and said end cap is positionable over said hose cap.

8. The assembly of claim 7, further comprising a hose couplable to said cushion, said hose having a first end and a second end wherein said first end of said hose is coupled to said cushion and said second end of said hose is configured for coupling to a water source, said hose being in fluid communication with said cushion when said first end is coupled to said hose cap and said hose cap is coupled to said tab.

9. The assembly of claim 1, further comprising a plug positioned in said cushion, said plug being selectively removable from said bottom side of said cushion wherein said plug is configured to release water from said interior space when said plug is removed from said cushion.

10. The assembly of claim 9, further comprising said plug being positioned on said leg portion proximate a bottom end of said cushion.

11. The assembly of claim 1, further comprising a plurality of suction cups coupled to said cushion, said suction cups extending downwardly from said bottom side of said cushion wherein said suction cups are configured to secure said cushion to a surface of a bathtub.

12. The assembly of claim 11, further comprising each of said suction cups comprising a working face coupled to an extension, said working face being curved wherein said working face is configured to attach to the bathtub when said working face is pressed against the surface of the bathtub.

13. The assembly of claim 1, further comprising said gel inserts extending the full length and width of said cavity.

14. A bathtub cushion assembly with gel inserts comprising:

a cushion having a head portion, a leg portion, and a middle portion extending between said head portion and said leg portion, said cushion having a top side positioned opposite a bottom side wherein said top side and said bottom side define an interior space configured to receive water and ice, each of said top side and said bottom side having a perimeter edge;

a flat portion of said top side extending from said head portion to said leg portion, said flat portion being defined by and inwardly bounded by said perimeter edge of said top side;

a laterally projecting lip extending from each of an associated one of said perimeter edges, each said lip being aligned with and extending a full length around said associated one of said perimeter edges, said lip of said top side protruding upwardly from said flat portion wherein said lip of said head portion is configured to provide support to a head of a user and said lip of said middle portion is configured to provide support to arms of the user;

wherein said lips are convexly curved around said head portion, said middle portion, and said leg portion, said lips of said middle portion and said leg portion each having a pair of curves positioned on an associated one of a first side and a second side of said cushion;

wherein said lip of said leg portion has a straight portion extending between and coupling said curves of said leg portion;

a neck support coupled to said cushion, said neck support extending upwardly from said flat portion of said head portion, said neck support being coupled to a bottom end of said head portion, a top side of said neck support having an arcuate depression configured for receiving a neck of the user;

a knee support coupled to said cushion, said knee support extending upwardly from said flat portion of said leg portion, a top side of said knee support having an outwardly curved projection configured for receiving a back side of a knee of the user;

a cavity extending downwardly into said top side of said cushion, said cavity extending through said interior space of said cushion, said cavity being positioned below said flat portion;

a plurality of gel inserts positioned in said cavity, said gel inserts extending the full length and width of said cavity wherein said gel inserts are configured to provide comfort to a back of the user and maintain a temperature of the water and ice stored in said interior space of said cushion, said cavity having a periphery configured to maintain said gel inserts in said cavity;

a tab coupled to said cushion, said tab extending outwardly from said first side of said cushion, said tab being coupled to said head portion;

a cap assembly couplable to said cushion, said cap assembly comprising a hose cap and an end cap, said hose cap being threaded, said cap assembly being selectively couplable to said head portion wherein said hose cap is couplable to said tab and said end cap is positionable over said hose cap, said end cap being configured to prevent water from exiting said interior space of said cushion when said end cap is coupled to said hose cap and said cap assembly is coupled to said cushion;

a hose couplable to said cushion, said hose having a first end and a second end wherein said first end of said hose is coupled to said cushion and said second end of said hose is configured for coupling to a water source, said hose being in fluid communication with said cushion when said first end of said hose is coupled to said hose cap and said hose cap is coupled to said tab;

a plug positioned in said cushion, said plug being selectively removable from said bottom side of said cushion wherein said plug is configured to release water from said interior space when said plug is removed from said cushion, said plug being substantially rectangular, said plug being positioned on said leg portion proximate a bottom end of said cushion; and a plurality of suction cups coupled to said cushion, said suction cups extending downwardly from said bottom side of said cushion wherein said suction cups are configured to secure said cushion to a surface of a bathtub, each of said suction cups comprising a working face coupled to an extension, said working face being curved wherein said working face is configured to attach to the bathtub when said working face is pressed against the surface of the bathtub.

* * * * *